United States Patent [19]

Watson

[11] 4,107,925

[45] Aug. 22, 1978

[54] STIRLING ENGINE

[76] Inventor: Sanders Chapman Watson, 1358 Roller Coaster Rd., Tucson, Ariz. 85704

[21] Appl. No.: 777,101

[22] Filed: Mar. 14, 1977

[51] Int. Cl.[2] ..... F02G 1/04

[52] U.S. Cl. ..... 60/521; 60/525

[58] Field of Search ..... 60/517, 519, 521, 523, 60/525, 526

[56] References Cited

U.S. PATENT DOCUMENTS

| | | | |
|---|---|---|---|
| 1,315,680 | 9/1919 | Nordberg | 91/500 |
| 1,943,664 | 1/1934 | Fear | 417/271 |
| 1,971,645 | 8/1934 | Ehmig | 123/56 BB |
| 2,653,484 | 9/1953 | Zecher | 92/69 B |
| 3,157,024 | 11/1964 | McCrory et al. | 60/525 |
| 3,196,698 | 7/1965 | Liddington | 92/147 |
| 3,830,208 | 8/1974 | Turner | 123/43 A |
| 3,852,961 | 12/1974 | Salomonsson et al. | 60/517 |

*Primary Examiner*—Allen M. Ostrager
*Assistant Examiner*—Stephen F. Husar
*Attorney, Agent, or Firm*—Cahill, Sutton & Thomas

[57] ABSTRACT

An eight cylinder rotary Stirling cycle engine ncludes first and second cylinder banks each comprising four cylinders having a fire box about the upper end of the cylinders and cooling fins about the lower end of the cylinders. The four cylinders of each bank are disposed about the centrally located longitudinal axis of each cylinder bank. A spacer divides each cylinder into a displacer cylinder and a power cylinder. A power piston and a displacer piston are disposed respectively in the power cylinder and the displacer cylinder and are rigidly connected together by a shaft. The lower porton of each displacer cylinder includes a displacer port, while the upper portion of each power cylinder includes a power port. A crossover pipe couples the displacer port of one displacer cylinder to a power port in an adjacent power cylinder. Since one of the two coupled cylinders is operating 90° out of phase with respect to the other cylinder, this method of coupling a displacer cylinder with an adjacent power cylinder provides the 90° phase shift required for proper engine operation. A vee transmission couples the two cylinder banks together and converts the reciprocating movement of the displacer and power pistons into rotatonal motion of the first and second cylinder banks. A power coupling shaft transmits the rotational motion derived from the rotating first and second cylinder banks to a point remotely located from the engine.

16 Claims, 5 Drawing Figures

STIRLING ENGINE

BACKGROUND OF THE INVENTION

1. Field of the Invention

This invention relates to external combustion engines, and more particularly, to multi-cylinder external combustion Stirling cycle engines.

2. Description of the Prior Art

One basic physical requirement of all engines operating in accordance with the Stirling cycle is that there must be approximately a 90° phase shift between cooperating displacer pistons and power pistons. One prior art method of providing the requisite 90° phase shift was to utilize a series of separate in-line displacer cylinders and power cylinders in combination with a crankshaft and a plurality of connecting rods for coupling together the various displacer pistons and power pistons to an output shaft while simultaneously providing the proper phase shift. One disadvantage of this method of providing the desired phase shift is that the in-line cylinder alignment necessarily requires a large, long fire box to provide heat to the upper portion of each of the displacer cylinders. The in-line cylinder configuration causes the engine to be large and quite difficult to incorporate in mobile installations.

A more modern versions of the Stirling engine incorporates a displacer piston and a power piston within a single cylinder by utilizing a pair of coaxial rods, one of which is coupled to the displacer piston and the other of which is coupled to the power piston. Since a 90° phase shift must still be maintained between each displacer piston and its cooperating power piston, an extremely elaborate and complex rhombic drive assembly must be positioned directly beneath each cylinder. While eliminating the requirement for separate displacer cylinders and power cylinders, the rhombic drive greatly increases the amount of space required to house the lower portion of the engine. Furthermore, the rhombic drive includes a large number of different types of parts, all of which contribute to a reduction in overall reliability of the engine.

An additional difficulty encountered by prior art Stirling engines arose as a result of the typically limited number of cylinders incorporated into any given engine. A limited number of cylinders causes the power derived from the engine to occur in pulses, often necessitating the addition of a massive flywheel to the output shaft of the engine to smooth the periodic acceleration and deceleration of the output shaft.

*The How And Why Of Mechanical Movements* by Harry Walton, pages 160–166, explains the structure and operation of several prior art Stirling engine designs. The following U.S. Patents disclose prior art engine and transmission designs related to the present invention: U.S. Pat. Nos. 3,830,208 (Turner); 3,196,698 (Liddington); 2,653,484 (Zecher); 1,971,645 (Ehmig); 1,315,680 (Nordberg); and 1,943,664 (Fear).

SUMMARY OF THE INVENTION

It is therefore a primary object of the present invention to provide a Stirling engine which includes a displacer piston and a power piston coupled directly together within a single cylinder of the engine by a single rigid shaft.

Another object of the present invention is to provide a Stirling engine having two banks of cylinders with four cylinders radially disposed about the longitudinal axis of each bank.

Yet another object of the present invention is to provide a Stirling engine which produces a rotational power output as a result of the reciprocating movement of its paired power pistons and displacer pistons within their respective cylinders.

Still another object of the present invention is to provide a Stirling engine in which there is no gas flow between the directly coupled displacer and power pistons within a single cylinder.

A still further object of the present invention is to control the rate of rotation of a Stirling engine by increasing or decreasing the gas pressure within the cylinders while the engine is operating.

A yet further object of the present invention is to provide a Stirling engine having a vee transmission for coupling together two opposing banks of four cylinders.

SUMMARY OF THE INVENTION

Briefly stated, and in record with one embodiment of the invention, an external combustion engine operating in accordance with the Stirling cycle is disclosed. The engine includes first and second cylinder banks of four cylinders each. Each of the cylinders within a bank is symmetrically disposed about a centrally located longitudinal axis. A dividing means divides each of the cylinders into axially aligned displacer cylinders and power cylinders and prevents gas flow between each pair of superimposed displacer and power cylinders. Each power cylinder includes a power piston and each displacer cylinder includes a displacer piston which pistons are rigidly connected by a shaft.

The lower portion of each displacer cylinder includes a displacer port, while the upper portion of each power cylinder includes a power port. A plurality of crossover pipes is provided to couple a displacer port of one cylinder to a power port of an adjacent cylinder and permit gas flow between the coupled displacer and power cylinders. A fire box surrounds and heats the upper portion of each displacer cylinder of each cylinder bank. A plurality of heat dissipating fins contact the lower portion of each displacer cylinder to dissipate heat therefrom and to reduce the transfer of heat from the fire box to the power pistons.

A vee transmission converts the reciprocating movement of the displacer pistons and power pistons into rotational motion of the first and second cylinder banks. A power coupling shaft transmits the rotational motion of the cylinder banks to a point remotely located from the engine.

DESCRIPTION OF THE DRAWING

The invention is pointed out with particularity in the appended claims. However, other objects and advantages, together with the operation of the invention, may be better understood by reference to the following detailed description taken in connection with the following illustrations, wherein:

DESCRIPTION OF THE PREFERRED EMBODIMENT

In order to better illustrate the advantages of the invention and its contributions to the art, a preferred hardware embodiment of the invention will now be described in detail.

Figure 1:
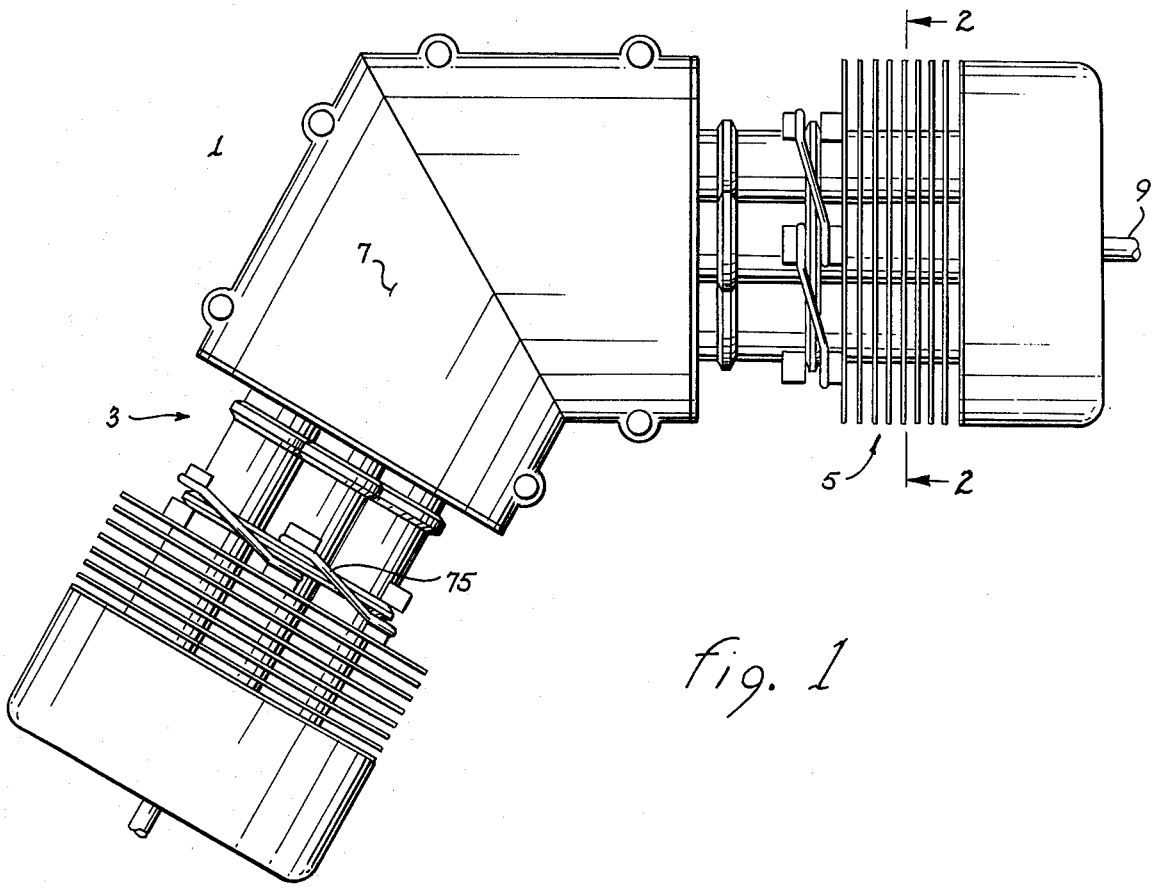
FIG. 1 is a perspective view of a complete Stirling engine of the present invention.

Referring to FIG. 1, Stirling Engine 1 includes a first bank 5 of four cylinders, a second bank 3 of four cylinders and a transmission housing 7 which couples the two banks of cylinders together.

Figure 2:
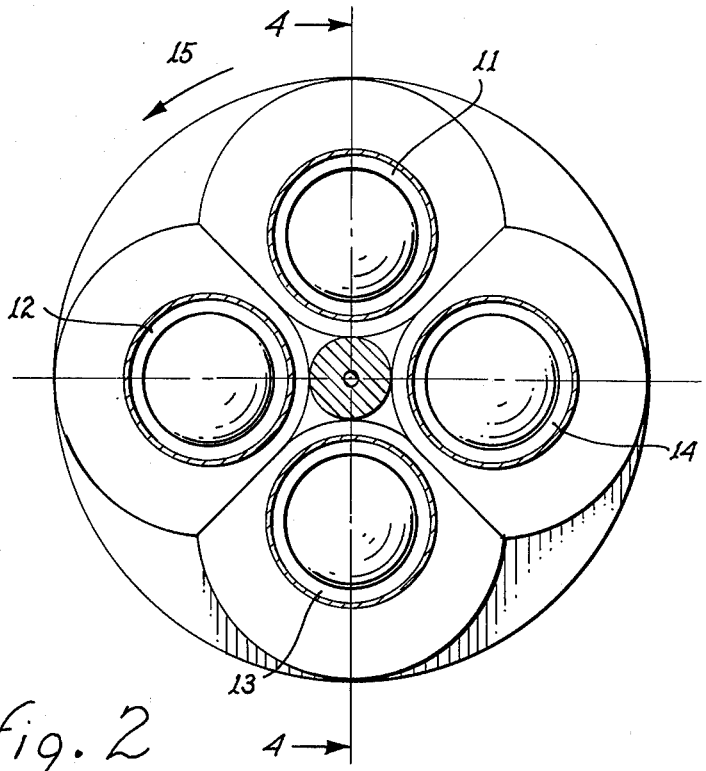
FIG. 2 is a sectional view of one bank of cylinders of the Stirling engine, taken along line 2—2.

FIG. 2 better illustrates the radial positioning of the four individual cylinders in the first bank of cylinders. For the purpose of this description, the four cylinders shown in FIG. 2 will be referred to as cylinders 11, 12, 13, and 14. The direction of rotation of the four cylinders shown in FIG. 2 will be assumed to be in a counterclockwise direction as indicated by arrow 15.

Figure 4:
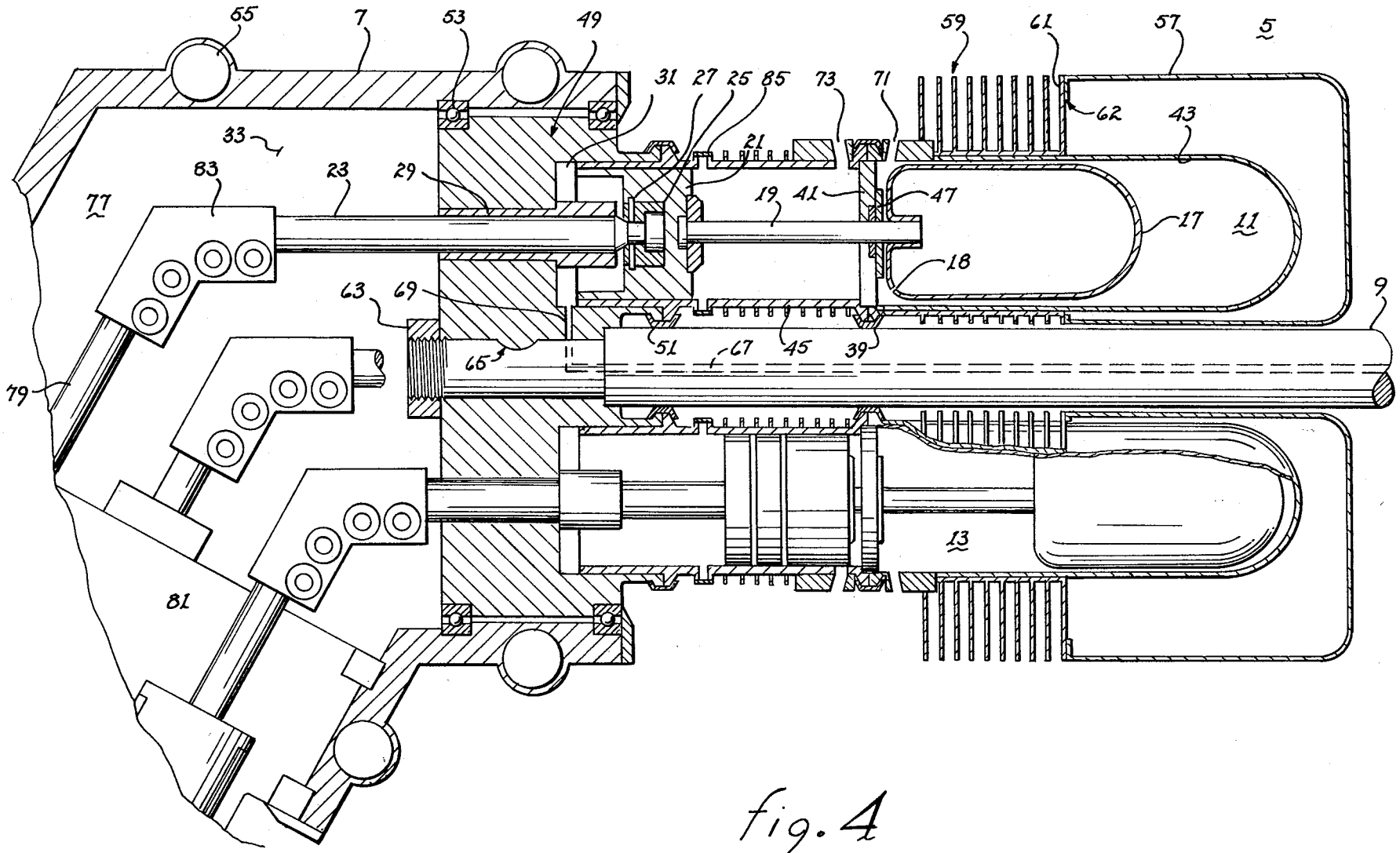
FIG. 4 is a sectional view of the Stirling engine of FIG. 2, taken along line 4—4.

Referring now to FIGS. 1 and 4, the specific structure of single bank of cylinders will be described in further detail. Each cylinder, such as cylinder 11, is divided into an upper section of displacer cylinder 43 and a lower section or power cylinder 45 by a cylindrical divider or spacer 41. The displacer cylinder 43 is secured to the power cylinder 45 by a screw-type overreaching clamp 39. Displacer cylinder 43 includes a hollow displacer piston 17, which is formed from a thin layer of copper alloy to assist in more rapidly equalizing the temperature of the gas inside of the displacer piston with the temperature of the gas in the displacer cylinder. Bleed port 18 prevents excessive pressure differentials between the interior of displacer piston 17 and displacer cylinder 43 which might otherwise tend to collapse the displacer piston. The displacer piston is coupled directly to shaft 19 which passes through spacer 41 and is rigidly secured to the upper surface of a power piston 21. The expanded head of a second slightly larger diameter shaft 23 is coupled to the lower end of power piston 21 by a split bushing 25 which is securely attached to the upper end of shaft 23 by a spring retaining clip 27. This method of attaching power piston 21 to shaft 23 allows rotation between piston 21 and the upper portion of shaft 23 as engine 1 operates. A sleeve bearing 29 permits reciprocation and relative rotational motion between shaft 23 and cylinder block 49.

Gas flow between displacer cylinder 43 and power cylinder 45 is precluded by spacer 41 and a seal 47 which is attached to spacer 41 and surrounds shaft 19.

Power cylinder 45 is coupled to cylinder block 49 by a second overreaching clamp 51 in a manner similar to that described above. While the outer surface of power piston 21 is designed to be in tight contact with the inner surface of power cylinder 45, an intentional gap exists between the outer surface of displacer piston 17 and the inner surface of displacer cylinder 43. The gap between the displacer piston and its cylinder wall is a well known feature of Stirling engines and is required for proper engine operation.

Cylinder block 49 is rotatably coupled to transmission housing 7 by a plurality of ball bearings, such as ball bearing 53. The entire engine assembly is rigidly mounted to a stationary surface by passing a plurality of mounting bolts through the mounting attach points, such as mounting attach point 55 in transmission housing 7.

Heat is provided to the upper portion of displacer cylinder 43 by fire box 57, the outer surface of which is insulated by a layer of asbestos. Fire box 57 includes a source of heat such as gas jets (not shown). Fire box 57 and transmission housing 7 are the only two elements of the Stirling engine which do not either rotate or reciprocate. A plurality of heat dissipating fins 59 extend from and surround the outer surface of displacer cylinder 43 to substantially reduce the downward flow of heat from the fire box 57 into the lower-most portions of cylinder 11. A low friction bearing surface 62 is provided between uppermost fin 61 and the lower portion of fire box 57 to permit relative rotation between uppermost fin 61 and fire box 57.

Power takeoff shaft 9 is centered about the centrally located longitudinal axis of first cylinder bank 5 and passes completely through cylinder block 49 to which it is threadably secured by nut 63. A slot and key combination indicated by reference number 65 rigidly secures shaft 9 to cylinder block 49 to prevent relative rotation therebetween. Shaft 9 includes a passageway 67 which is coupled to a separate passageway 69 in cylinder block 49. Passageways 67 and 69 permit the introduction of a gas under pressure from an external source into pressurized chamber 31. Pressurized chamber 31 is under cut into cylinder block 49 below a portion of each of the four cylinders of first cylinder bank 5 in such a way that it allows communication between passageway 69 and the portion of each power cylinder which lies below each power piston of first cylinder bank 5. A special sealed gland (not shown) of a design well known in the art surrounds shaft 9 at a location beyond fire box 57 and permits a pressurized gas to be introduced into and removed from passageway 67 at controlled rates as shaft 9 rotates. Shaft 23 and sleeve bearing 29 are machined to a sufficiently close tolerance to minimize the leakage of gas from pressurized chamber 31 into chamber 33 which is formed by transmission housing 7.

Each cylinder, such as cylinder 11, includes a displacer port 71 and a power port 73. Displacer port 71 allows the gas within the lower portion of displacer cylinder 43 to pass in and out of the cylinder while power port 73 allows the gas within the upper portion of power cylinder 45 to pass in and out of that section of cylinder 11. Each displacer port is coupled to the power port of one of the adjacent power cylinders by a crossover pipe, such as crossover pipe 75 as shown in FIG. 1. Displacer port 71 of cylinder 11 is coupled either to the power port of cylinder 14 or to the power port of cylinder 12, depending on the desired direction of rotation of the engine. For the counterclockwise direction of rotation assumed for illustrative purposes, displacer port 71 of cylinder 11 will be coupled to the power port of cylinder 14. In a similar manner, power port 73 of cylinder 11 will be coupled to the displacer port of either cylinder 12. Adjacent displacer ports and power ports are coupled together by tubes known as crossover pipes, such as crossover pipe 75 shown in FIG. 1. The routing of the crossover pipes in the second bank of cylinders is exactly the mirror image of the positioning of the crossover pipes in the first bank of cylinders. If the crossover pipes are inadvertently positioned improperly for the desired direction of rotation, the engine will rotate in the opposite direction.

The coupling of a displacer port to the power port of an adjacent cylinder, while preventing the transfer of pressurized gases from coaxially located power cylinders and displacer cylinders, provides the requisite 90° phase shift for the operation of this embodiment of the Stirling engine. The requirement for physically separate displacer cylinders and power cylinders is eliminated by this design. Also, the requirement for a rhombic drive in combination with a pair of coaxially positioned connecting rods is also avoided. In the present embodiment the displacer piston 17 is rigidly coupled to power piston 21 by shaft 19; there is absolutely no differential movement between these two directly coupled pistons.

The coupling of the four sets of pistons within the four cylinders of each bank among themselves and with the second set of pistons in the second cylinder bank is accomplished by a specially designed vee transmission 77. A plurality of shafts, such as shaft 79, extend from cylinder block 81 of the second cylinder bank 3. Shafts 23 and 79 are of identical length and are rigidly coupled together at a predetermined angle, which is less than 180° and equal to or greater than 90°, by coupling 83. Since there are four cylinders per bank, there will be four identical sets of couplings, such as coupling 83, and four identical pairs of shafts, such as shaft 23 and shaft 79. The eight shafts are identical and the four couplings are identical.

As vee transmission 77 moves around a complete circle, coupling 83 will be displaced upwardly and downwardly and fore and aft, but will not rotate relative to transmission housing 7. Shafts 23 and 79 will move in and out of cylinder blocks 49 and 81 as the engine rotates, but the shafts do not rotate. Free rotational movement between shaft 23 and cylinder block 49 is provided by sleeve bearing 29, while free rotational movement between power piston 21 and shaft 23 is provided by the combination of the split bushing 25 and the spring retaining clip 27. Thus, as each of the two cylinder banks of the engine rotate in unison, each piston within a particular cylinder will accomplish one completed upward and downward reciprocation. Each piston will return to the same position after each 360° rotation of its cylinder bank.

Transmission housing 7 remains stationary at all times and serves as a rigid mounting point for the rotational elements of the engine, while preventing the introduction of oil and dirt into the rapidly moving transmission assembly.

Vee transmissions of this type are known and have been used primarily for pump and motor combinations. U.S. Pat. Nos. 1,315,680 and 1,943,664, which are hereby incorporated by reference, described vee transmissions which are similar to the type used in the present invention.

The Stirling engine as presently described operates as a result of the Stirling cycle which has been known for a substantial length of time. The advantages of the present embodiment reside in the fact that it can be fabricated in a very small package approximately the size of a shoe box, while including a plurality of eight cylinders to permit a very smooth and uniform power output. The compact dimensions of the present embodiment result from the very high density structural configuration in which each bank of four cylinders is symmetrically disposed about its power take-off shaft. Since the classic inline Stirling engine configuration which requires separate displacer cylinders and separate power cylinders in combination with a crank shaft is eliminated, and since the rhombic drive assembly of the alternative Stirling engine configuration is not required to provide the requisite 90° phase shift, substantial weight and space savings can be accomplished by the present design.

An inert gas such as Freon or helium is typically used in the Stirling engine of the preferred embodiment since these gases have a greater rate of expansion for a given change in temperature than air, although air is an acceptable substitute. A pair of capillary bypass chambers, such as chamber 85, are positioned on diametrically opposing sides of each power cylinder at a position just above the upper surface of the power piston when it is at the lowermost position in the cylinder. If it is desired to increase the operating speed of the engine, additional inert gas is introduced through passageway 67 in shaft 9 into pressurized chamber 31 of first cylinder bank 5. If desired, additional gas may be introduced into second cylinder bank 3 in a similar manner. As power piston 21 approaches the uppermost position in power cylinder 45, the openings of each of the capillary bypass chambers are exposed to the pressurized gas in pressurized chamber 31. The openings to the two capillary bypass chambers are swept and thereby are sealed off by power piston 21 as it transitions from its uppermost to its lowermost position within the cylinder. As power piston 21 reaches the bottom dead center position, the openings of both capillary bypass chambers become unobstructed and the small quantity of pressurized gas within each bypass chamber is allowed to escape into the cylinder section lying above the upper surface of power piston 21. After several complete reciprocations of power piston 21 have been completed, a significant amount of gas will have been transferred from pressurized chamber 31 into power cylinder 45. As each crossover pipe permits direct communication between power cylinder 45 and the displacer cylinder of an adjacent cylinder, an increased or decreased quantity of gas can be transferred to each of the power cylinders and to each of the displacer cylinders by altering the pressure of the gas in pressurized chamber 31 and allowing the engine to operate for a predetermined time thereafter. An increased quantity of gas in the cylinders will cause the engine RPM to increase, while a decrease in the quantity of gas will produce a reduction in the engine speed.

As an alternative means for regulating the engine speed, a two-way valve could be inserted in the wall of transmission housing 7 to transfer gas into or out of the area enclosed by the housing. In this embodiment a gas-tight seal between each of the cylinder blocks and the transmission housing must be provided. An additional passageway extending from pressurized chamber 31 to the interior of the transmission housing must be included to allow the change in gas pressure within the transmission housing to be communicated to the pressurized chamber 31. This alternative embodiment will accomplish the same result discussed above in connection with the transfer of gas through power takeoff shaft 9.

Figure 3:
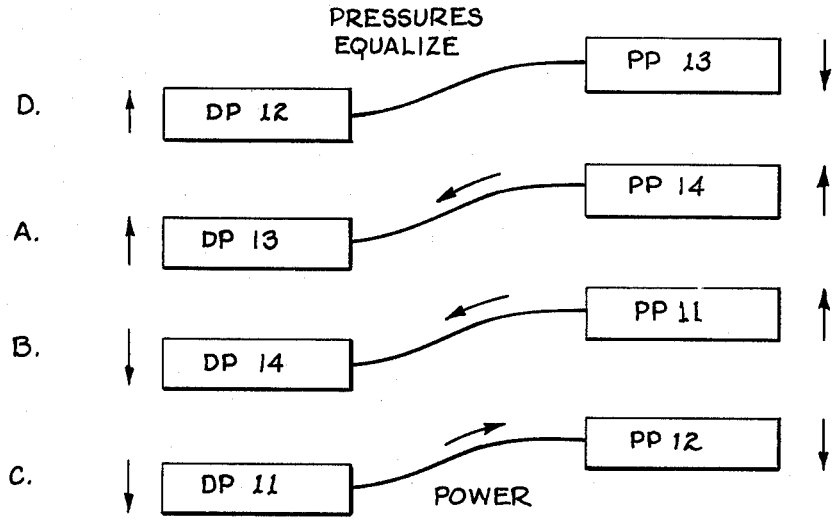
FIG. 3 is a table which assists in describing the gas flow through the crossover pipes of one four cylinder bank of the Stirling engine.
Figure 5:
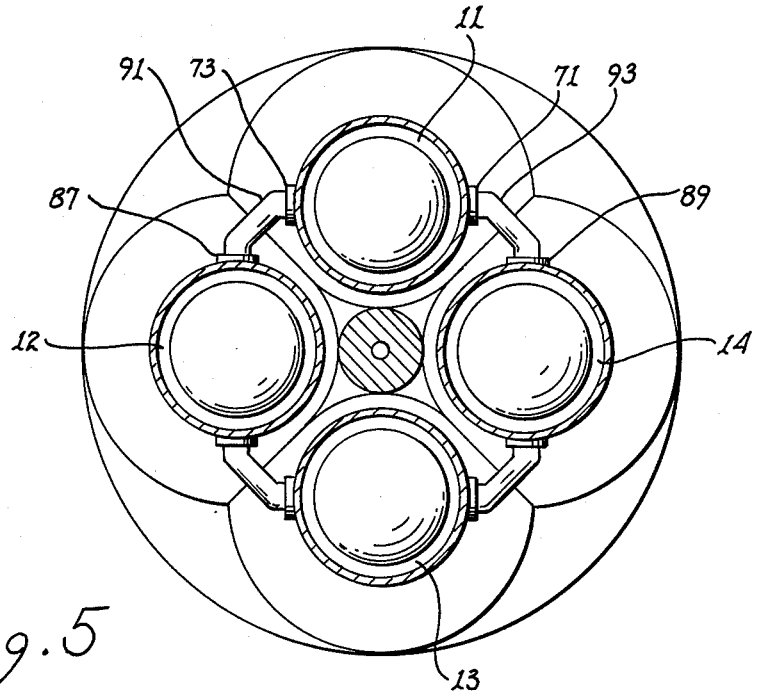
FIG. 5 is a diagram of one bank cylinders of the Stirling engine indicating an improved placement of the displacer ports and power ports to allow a substantial reduction in the length of the crossover pipes.

An improvement can be made in the operating efficiency of the engine by minimizing the length of the crossover pipes which connect adjacent displacer ports and power ports. Instead of positioning the displacer port and crossover port directly above one another as is shown in FIG. 1 and FIG. 3, the length of each individual crossover pipe can be minimized by offsetting the displacer port and the power port 90° with respect to each other as is shown in FIG. 5. In FIG. 5, power port 73 of cylinder 11 is offset 90° from displacer port 71 around the outer wall of cylinder 11. The displacer ports and power ports of the various other cylinders are similarly positioned. The improved embodiment includes crossover pipe 91 which couples power port 73 of cylinder 11 to displacer port 87 of cylinder 12. Similarly, crossover pipe 93 couples displacer port 71 of cylinder 11 to power port 89 of cylinder 14.

The manner of positioning the cylinder ports and the crossover pipes reduces the heat loss from the crossover pipes and the amount of back pressure present in the crossover pipes. The thermal efficiency of the engine is thereby increased.

OPERATION OF THE PREFERRED EMBODIMENT

As no Stirling engine is self-starting, a prime mover of some sort must initiate rotation of the engine. Thereafter, the engine is self-sustaining. For the purpose of discussing the operation of this engine, it will be assumed that each of the cylinders has been purged of undesired gases by introducing a predetermined quantity of an appropriate gas, such as helium, prior to the commencement of operation.

Referring now to FIG. 3 and FIG. 4, the operation of the preferred embodiment will be explained. Once again, counterclockwise rotation of the right cylinder bank will be assumed. FIG. 4 illustrates power piston 21 and displacer piston 17 of cylinder 11 moving downward and approaching the bottom dead center position. The power piston and displacer piston in cylinder 13 are moving upward and are approaching the top dead center position. The pistons within cylinders 12 and 14 are not shown in FIG. 4, but each is passing the midway position. The pistons in cylinder 12 are moving upward while the pistons in cylinder 14 are moving downward.

In FIG. 3, the abbreviation DP is used to designate a specific displacer piston, while the abbreviation PP is used to designate a specific power piston. Each of the combination of numbers and letters lying within the rectangles, such as DP12, designates the type of piston and the cylinder designation in which that piston is located. The vertically oriented arrow positioned adjacent each rectangular box designates the direction of movement of the piston indicated by the rectangular box. The solid lines connecting the rectangular boxes in the left hand column with the rectangular boxes in the right hand column correspond to the crossover pipes; the arrows oriented parallel to the solid lines designate the direction of gas flow within each crossover tube. The direction of piston movement and gas flow illustrated in FIG. 3 corresponds to the position and direction of movement of the pistons shown in FIG. 4.

The left-most column in FIG. 3 designates by letter the element of the Stirling cycle which each cooperating power piston and displacer piston is accomplishing. In cycle A power piston 12 and displacer piston 13 are moving upward. The upward movement of power piston 12 transfers the cool gas above power piston 12 into the lower portion of displacer cylinder 43 of cylinder 13. This section of cylinder 13 is maintained at a relatively cool temperature by the plurality of cooling fins which are positioned therearound. The net effect of the upward motion of power piston 12 and displacer piston 13 is to compress the relatively cool gas into the relatively cool space in the lower part of power cylinder 43.

In cycle B which is occurring as a result of the relative motion between power piston 13 and displacer piston 14, power piston 13 is just about to reach the top dead center position, while displacer piston 14 is moving downward and passing the midposition within its cylinder. Displacer piston 14 is thus transferring some of the relatively cool gas from the lower portion of its cylinder section to the heated upper section of displacer cylinder 45. This compressed air which is being displaced to the cylinder area above displacer piston 14, is now heated and begins to expand.

Cycle C which occurs as a result of the relative motion of displacer piston 11 and power piston 14, produces the power stroke of the Stirling cycle. The heated compressed air which was transferred to the upper portion of the displacer cylinder by step B discussed above, had not been previously substantially heated. This transferred relatively cool compressed gas is heated as a result of contact with the hot upper section of the displacer cylinder, causing a substantial expansion of the gas. This expansion creates a very powerful downward force on the upper portion of displacer piston 11. The rapidly expanding gas which is passing between the inner surface of the displacer cylinder and the outer surface of the displacer piston in cylinder 11 passes through the crossover pipe and into the upper section of the adjacent power cylinder in cylinder 14, exerting a strong downward force on the power piston.

In cycle D, the final downward movement of the power piston in cylinder 11 is occurring as a result of the expansion of the heated gases from cycle C. The displacer piston in cylinder 12 is now just beginning its upward motion. Cycle D represents the termination of the power stroke and the flow of gas through the crossover pipe between these two pistons changes direction upon the completion of cycle D before the beginning of cycle A in order to equalize the pressures between the coupled power piston and displacer piston.

It will be apparent to those skilled in the art that the disclosed Stirling engine may be modified in numerous ways and may assume many embodiments other than the preferred form specifically set out and described above. For example, a water or forced air cooling system for cooling the lower section of the displacer cylinder could be used as a substitute for the heat dissipating fins disclosed in connection with the preferred embodiment. The length and configuration of the crossover pipes can be altered, although the maximum efficiency for the engine is reached when the length of the crossover pipes is minimized by positioning adjacent displacer and power ports as cloase as possible. The length of the stroke of each of the pistons can be altered by altering the angle of the vee transmission. It would also be possible to increase and decrease the amount of gas within the cylinders by utilizing injection tubes coupled to the crossover pipes or directly to the cylinders for injecting gas into the cylinders instead of using the capillary bypass tubes as disclosed. Accordingly, it is intended by the appended claims to cover all such modifications of the invention which fall within the true spirit and scope of the invention.

What is claimed is:

1. An external combustion engine operating in accordance with the Stirling cycle, said engine comprising in combination:

(a) a first cylinder bank comprising four cylinders symmetrically disposed about a first centrally located longitudinal axis of said first bank and a first cylinder lock disposed at the lower end of said first cylinder bank for rigidly securing the lower end of each of said cylinders;

(b) a second cylinder bank comprising four cylinders symmetrically disposed about a second centrally locaed longitudinal axis of said second bank and a second cylinder block disposed at the lower end of said second cylinder bank for rigidly securing the lower end of each of said cylinders;

(c) means for dividing each of said cylinders into a displacer cylinder in axial alignment with a power cylinder to prevent gas flow between said displacer cylinder and said power cylinder, each of said displacer cylinders and said power cylinders having an upper portion and a lower portion;

(d) a power piston disposed in each said power cylinder of said cylinders in said first and said second cylinder banks;

(e) a displacer piston disposed in each said displacer cylinder of said cylinders in said first and said second cylinder banks;

(f) first means for rigidly connecting in spaced relationship each axially aligned displacer piston and power piston within each respective one of said cylinders in said first cylinder bank;

(g) second means for rigidly connecting in spaced relationship each axially aligned displacer piston and power piston within each respective one of said cylinders in said second cylinder bank;

(h) first crossover means for permitting gas flow between each of said power cylinders in said first cylinder bank and an adjacent one of said displacer cylinders;

(i) second crossover means for permitting gas flow between each of said power cylinders in said second cylinder bank and an adjacent one of said displacer cylinders;

(j) means for heating the upper portion of each of said displacer cylinders;

(k) means for dissipating heat from the lower portion of each of said displacer cylinders and for reducing the heat transfer from the upper portion of said displacer cylinders to said power cylinders;

(l) vee transmission means for converting the reciprocating movement of said displacer pistons and said power pistons into rotational motion of said first and said second cylinder banks, said vee transmission means comprising:

i. a transmission housing for rotatably mounting said first and said second cylinder blocks and for maintaining a fixed angle between the first and the second longitudinal axes of said first and said second cylinder banks;

ii. a first group of four shafts each said shaft being slidably mounted within said first cylinder block and axially aligned with one of said first connecting means, each said shaft having a first end extending from said first cylinder block and a second end rotatably coupled to one of said power pistons within said first cylinder bank;

iii. a second group of four shafts each said shaft being slidably mounted within said second cylinder block and axially aligned with one of said second connecting means, each said shaft having a first end extending from said second cylinder block and a second end rotatably coupled to one of said power pistons within said second cylinder bank;

iv. means positioned within said transmission housing for rigidly coupling the first end of each said shaft in said first group to an aligned one of the first end of said shafts in said second group; and (m) power coupling means for transmitting the rotational motion imparted by at least one of said first second cylinder blocks to a point remotely located from said engine.

2. The engine according to claim 1 further including means for transferring a gas into and out of the upper portion of each of said power cylinders in said first cylinder bank.

3. The engine according to claim 2 wherein said transferring means includes first passage means passing through said power coupling means for conveying the gas between a point remotely located from said engine and the lower portion of each of said power cylinders of said first cylinder bank.

4. The engine according to claim 3 wherein said first passage means includes first bypass means disposed in each of said power cylinders of said first cylinder bank for passing the gas between the lower portion of each of said power cylinders and the upper portion of said power cylinder.

5. The engine according to claim 4 wherein each said power piston includes an upper and a lower edge and wherein said first bypass means includes a capillary bypass chamber disposed at a point on each of said power cylinders which is swept by the upper and lower edges of the respective one of said power pistons, whereby the gas is incrementally transferred into and out of the upper portion of said power cylinders.

6. The engine according to claim 3 wherein said transferring means further includes second passage means passing through said power coupling means for conveying the gas between a point remotely located from said engine and the lower portion of each of said power cylinders of said second cylinder bank.

7. The engine according to claim 6 wherein:

(a) said first passage means includes first bypass means disposed in each of said power cylinders of said first cylinder bank for passing the gas between the upper and lower portions of each of said power cylinders;

(b) said second passage means includes second bypass means disposed in each of said power cylinders of said second cylinder bank for passing the gas between the upper and lower portions of each of said power cylinders.

8. The engine according to claim 7 wherein each said power piston includes an upper and a lower edge and wherein each said first and said second bypass means include a capillary bypass chamber disposed at a point on each of said power cylinders which is swept by the upper and lower edges of the respective one of said power piston, whereby the gas is incrementally transferred into and out of the upper portion of said power cylinders.

9. The engine according to claim 1 wherein said heating means includes a first fire box positioned adjacent the upper portion of each of said displacer cylinders in said first cylinder bank and a second fire box disposed adjacent the upper portion of each of said displacer cylinders in said second cylinder bank.

10. The engine according to claim 1 wherein said heat dissipating means includes a plurality of fins disposed about each of said displacer cylinders of said first and said second cylinder banks.

11. The engine according to claim 1 wherein each said first crossover means includes a plurality of crossover pipes.

12. The engine according to claim 1 wherein each of said displacer pistons is fabricated from a lightweight, heat conductive material.

13. The engine according to claim 13 wherein said lightweight, heat conductive material includes a copper alloy.

14. The engine according to claim 1 wherein each said first and second connecting means includes a shaft.

15. The engine according to claim 1 wherein said power coupling means includes at least one shaft disposed symmetrically about the first centrally located longitudinal axis of said first cylinder bank and secured to said first cylinder bank.

16. The engine according to claim 15 wherein said power coupling means further includes a second shaft disposed symmetrically about the second centrally located longitudinal axis of said second cylinder bank and secured to said second cylinder bank.

* * * * *